US006347626B1

(12) United States Patent
Yi

(10) Patent No.: US 6,347,626 B1
(45) Date of Patent: Feb. 19, 2002

(54) VENTILATION SYSTEM FOR A KITCHEN

(76) Inventor: Seong-Hwan Yi, Yoowonhongeun Apartment 2-201, San 22, Hongeun 2-dong, Seodaemoon-ku, Seoul (KR)

( * ) Notice: Subject to any disclaimer, the term of this patent is extended or adjusted under 35 U.S.C. 154(b) by 0 days.

(21) Appl. No.: 09/617,059

(22) Filed: Jul. 15, 2000

(30) Foreign Application Priority Data

Jul. 24, 1999 (KR) ..... 99-30192

(51) Int. Cl.[7] ..... F24C 15/20

(52) U.S. Cl. ..... 126/299 D; 126/299 R; 55/DIG. 36

(58) Field of Search ..... 126/299 R, 299 D, 126/19 R, 21 R; 55/DIG. 36; 454/66, 252

(56) References Cited

U.S. PATENT DOCUMENTS 3,585,919 A * 6/1971 Culpepper, Jr. ..... 126/299 D
4,134,394 A * 1/1979 Otenbaker ..... 126/299 D
4,484,563 A * 11/1984 Fritz et al. ..... 126/299 D
5,312,296 A * 5/1994 Aalto et al. ..... 126/299 R

* cited by examiner

*Primary Examiner*—James C. Yeung
(74) *Attorney, Agent, or Firm*—Stephen J. Koundalgian; Charles W. Fallow

(57) ABSTRACT

A ventilation system for kitchens for removing fumes from the space above a cooking appliance, working together with a kitchen hood disposed above the cooking appliance, is disclosed. The system comprises: a suction element installed in the ceiling near the location of the kitchen hood; an exhaust duct connection the suction element and a ventilation funnel of the building; an exhaust fan installed in the exhaust duct; a means for capturing fumes installed in the ceiling near the suction element at the opposite side from the kitchen hood, drawing fumes from the cooking appliance to the suction element by jetting air to the suction element; and an air supply element connecting the suction element and the means for capturing fumes, with a suction fan installed in the air supple element. The disclosed system can improve the air quality of a kitchen, prevent fumes from the cooking appliance spreading to other spaces, and decrease heat buildup in the kitchen.

6 Claims, 8 Drawing Sheets

VENTILATION SYSTEM FOR A KITCHEN

BACKGROUND OF THE INVENTION

1. Field of the Invention

The present invention relates to a ventilation system used in a kitchen, more particularly, a kitchen ventilation system for removing fumes from the space above a cooking appliance, working together with an exhaust hood disposed above the cooking appliance, so that the system can improve the air quality within a kitchen, prevent fumes from spreading to other places, and decrease heat buildup within a kitchen.

2. Description of Prior Art

It is well known that the main pollutants of the atmosphere in a house or a large restaurant are fumes from a cooking appliance, activated by heat.

The heat is generated as radiant heat and convection heat, generated from the cooking appliance in the kitchen. Fumes, such as grease and other cooking-related gases, rise with heat and spread to other places.

As shown in FIG. 1, in the kitchen of a house or a restaurant, generally a kitchen hood 2 is equipped above a cooking appliance 1, such as a cooking table or a range, so that the kitchen hood 2 inhales (i.e., draws in) the cooking fumes from the cooking appliance 1 and discharges them into the outer atmosphere.

However, the maximum efficiency of such a general kitchen hood 2 in discharging the fumes is only about 70 percent. Therefore, the remnant (about 30 percent or more) of the fumes rises with the cooking heat and spreads to other places.

Moreover, the efficiency of the kitchen hood decreases in proportion to the time of use because grease collects in a duct or a gate of the kitchen hood.

One of the ventilation systems for overcoming the shortcomings of the aforesaid conventional kitchen hood is disclosed as follows, as shown in FIG. 2.

The ventilation system shown in FIG. 2 comprises a hood 2 that is placed above the cooking appliance 1, an exhaust port 3 installed in the ceiling of the kitchen near the hood 2, and an air curtain device 4 installed near the entrance of the kitchen, which is for isolating the kitchen from other rooms of a house.

The ventilation system is provided in order to exhaust the remnant overflowing fumes from the cooking appliance 1, that the hood 2 cannot inhale.

When there are overflowing fumes that the exhaust port 3 cannot inhale, the air curtain device 4 prevents the overflowing fumes from spreading into other portions of the house.

However, the ventilation system also has shortcomings in that the inhaling capacity of the exhaust port is limited in home use, so it is impossible to inhale and discharge the fumes completely. In particular, the system cannot inhale fumes that are more distant than six times the diameter of the exhaust port 3.

Also, the overflowing fumes circulate in the kitchen because of the air curtain device, causing the air quality of the kitchen to worsen.

Moreover, the effect of the home air conditioner cannot reach the kitchen because of the blocking caused by the air curtain device 4. Therefore, the heat buildup in the kitchen becomes more serious.

According to a simulation of such a ventilation system, the air curtain device lacks the capacity to prevent the fumes from spreading to other spaces. Instead, the system causes air flow turbulence in a kitchen, making matters worse.

SUMMARY OF THE INVENTION

It is an object of the present invention to provide a ventilation system for a kitchen for removing fumes from the space above a cooking appliance, working together with a kitchen hood disposed above the cooking appliance, so that the system can improve the air quality of a kitchen, prevent the fumes from spreading to other spaces, and decrease heat buildup in a kitchen.

According to an aspect of the above object, there is provided a ventilation system used in a kitchen for removing fumes from the space above a cooking appliance with a kitchen hood disposed above the cooking appliance, the system comprising: a suction element installed in the ceiling near the location of the kitchen hood; an exhaust duct connecting the suction element to the ventilation funnel of the building; an exhaust fan installed in the exhaust duct; a fume capturing means installed in the ceiling near the suction element at the opposite side of the suction element from the kitchen hood, for drawing fumes from the cooking appliance to the suction element by jetting air to the suction element along the ceiling; and an air supply element connecting the suction element and the means for capturing fumes, with a suction fan installed in the air supply element. An auxiliary suction inlet may be disposed in the ceiling, near the kitchen hood, to provide a further inlet to the fume capturing means.

BRIEF DESCRIPTION OF THE DRAWING[S]

DETAILED DESCRIPTION OF THE PREFERRED EMBODIMENTS

Figure 1:
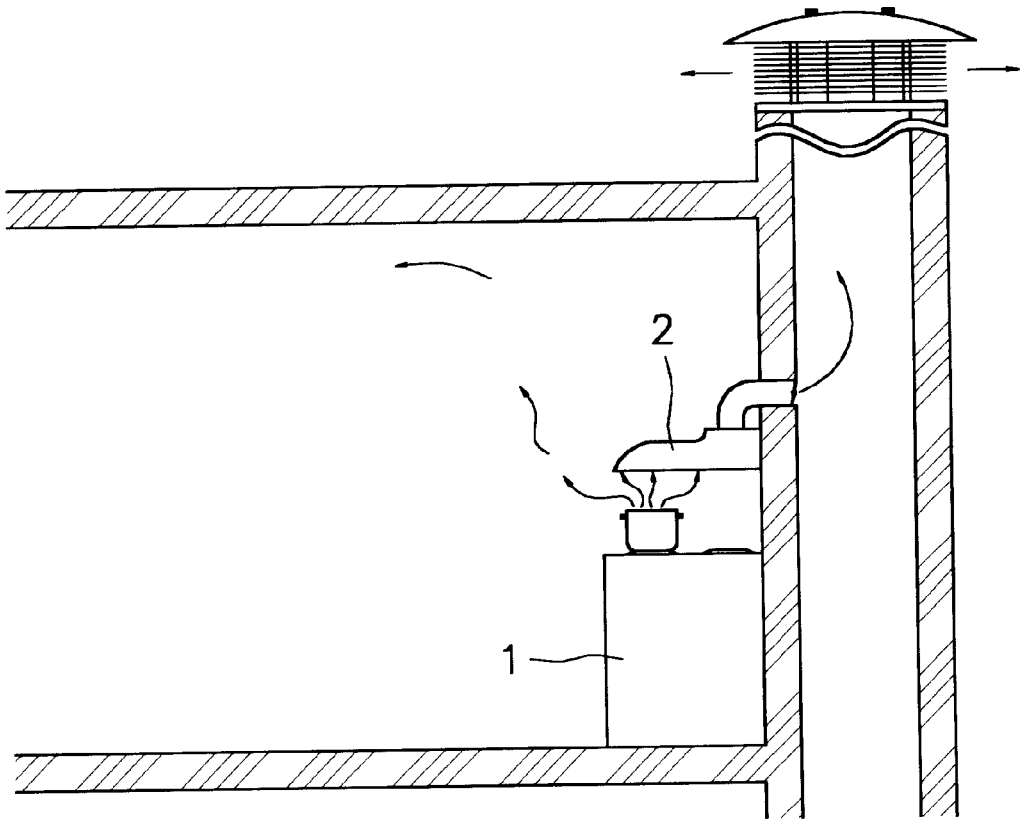
FIG. 1 PRIOR ART
FIG. 1 is a schematic view showing a prior art kitchen ventilation system.
Figure 2:
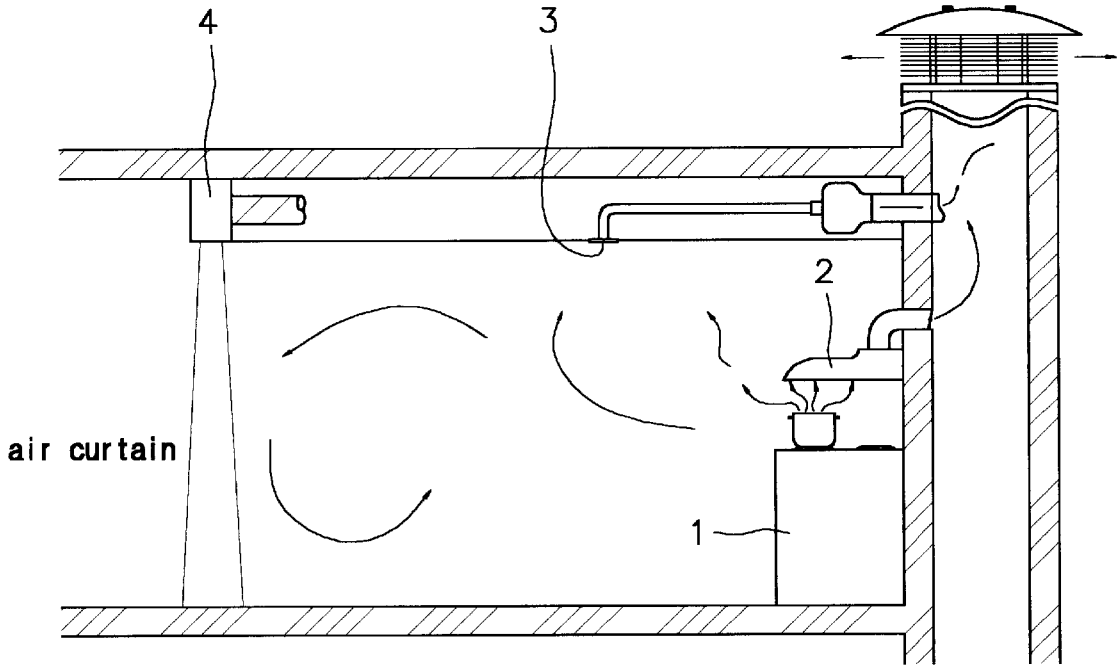
FIG. 2 PRIOR ART
FIG. 2 is a schematic view showing an improved prior art kitchen ventilation system.
Figure 3:
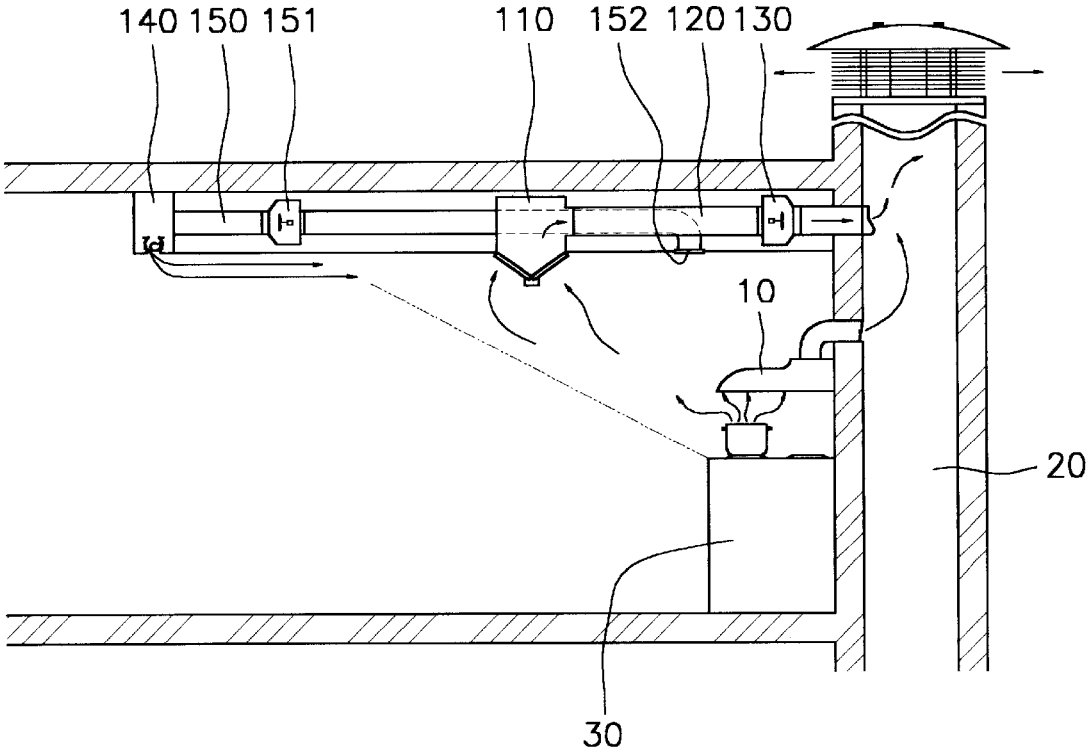
FIG. 3 is a schematic view of the present invention.
Figure 4:
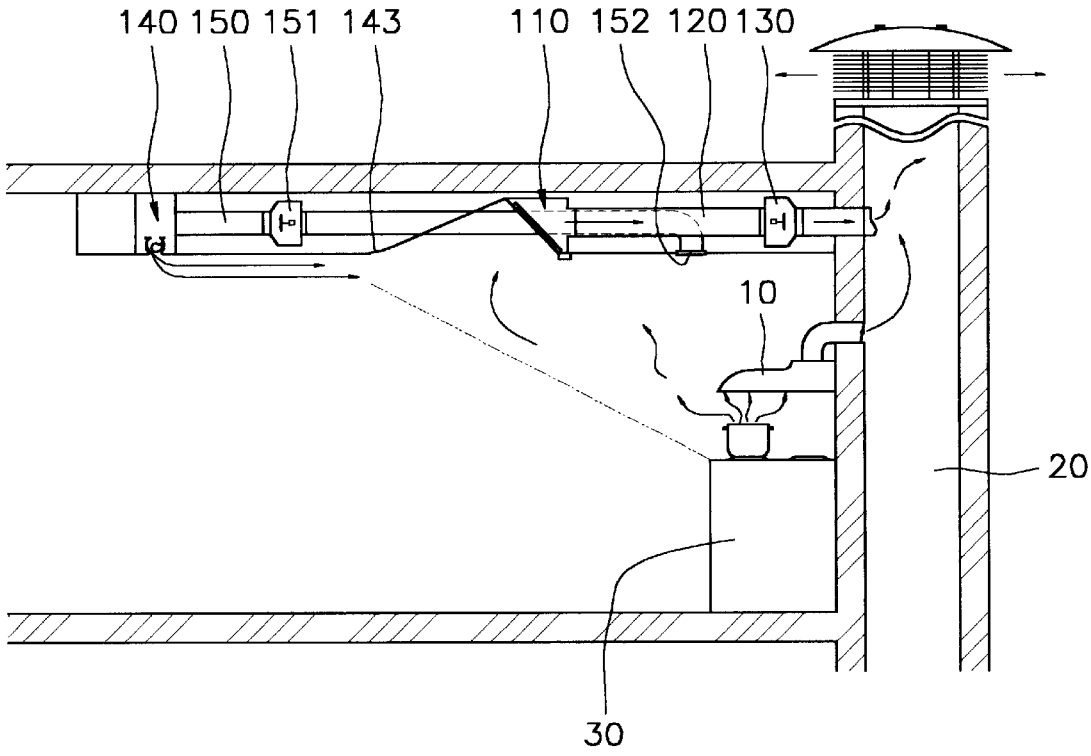
FIG. 4 is a schematic view of the present invention according to another embodiment.

As shown in FIGS. 3 and 4, the present invention of a ventilation system comprises a suction element 110 installed in a ceiling near the place where the kitchen hood 10 is located; an exhaust duct 120 connecting the suction element 110 to the ventilation funnel 20 of a building; an exhaust fan 130 installed in the exhaust duct 120; a means for capturing fumes 140 installed in the ceiling near to the suction element 110 but at the opposite side from the kitchen hood 10, to draw fumes from the cooking appliance 30 to the suction element 110 by jetting air to the suction element 110, and an air supply element 150 connecting the auxiliary suction inlet 152 and the means for capturing fumes 140, with a suction fan 151 installed therein. As shown in FIGS. 3 and 4, the suction fan 151 thus draws a portion of the fumes from the cooking appliance 30 to the fume capturing means 140 through the auxiliary suction inlet 152, disposed in the ceiling, near the kitchen hood 10.

Figure 5A:
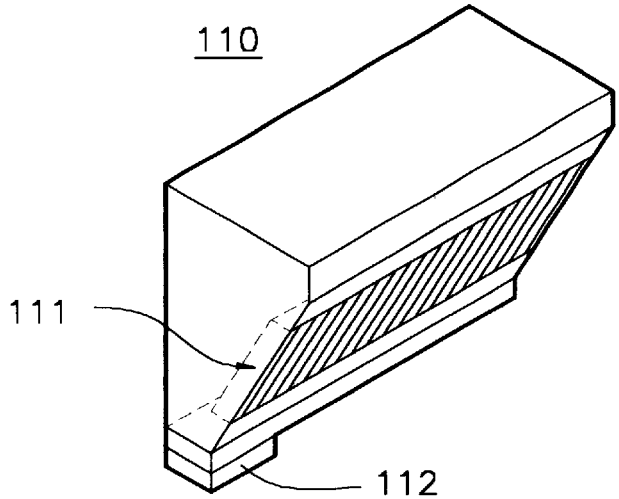
FIGS. 5A and 5B are perspective views of the suction element of the present invention.
Figure 5B:
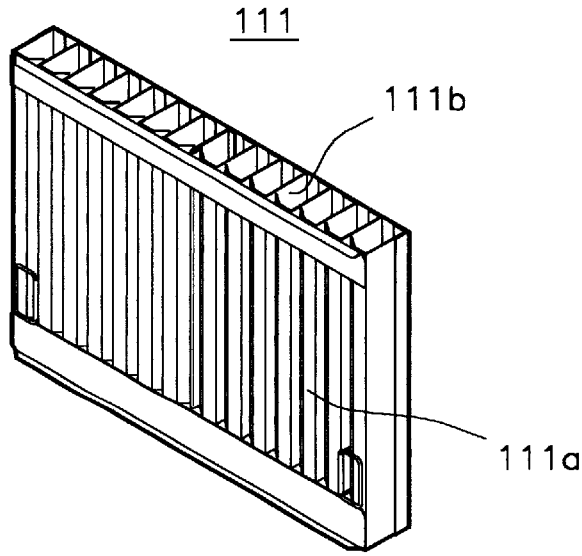

As shown in FIGS. 5A and 5B, the suction element 110 comprises: a grease filter 111 having a filtering portion 111*a*; a damper plate 111*b*, which is installed diagonally to the ceiling; and a collection element 112 for collecting and clearing the grease or pollutant captured by the grease filter 111.

Figure 6:
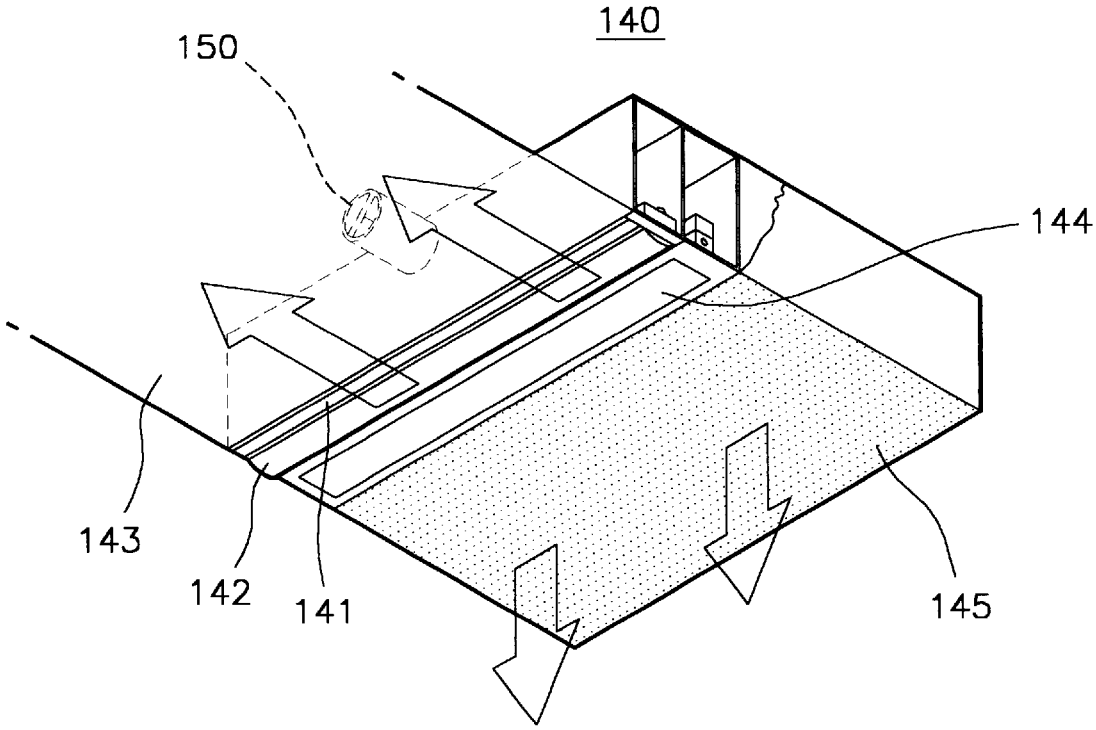
FIG. 6 is a perspective view of the means for capturing fumes of the present invention.
Figure 7A:
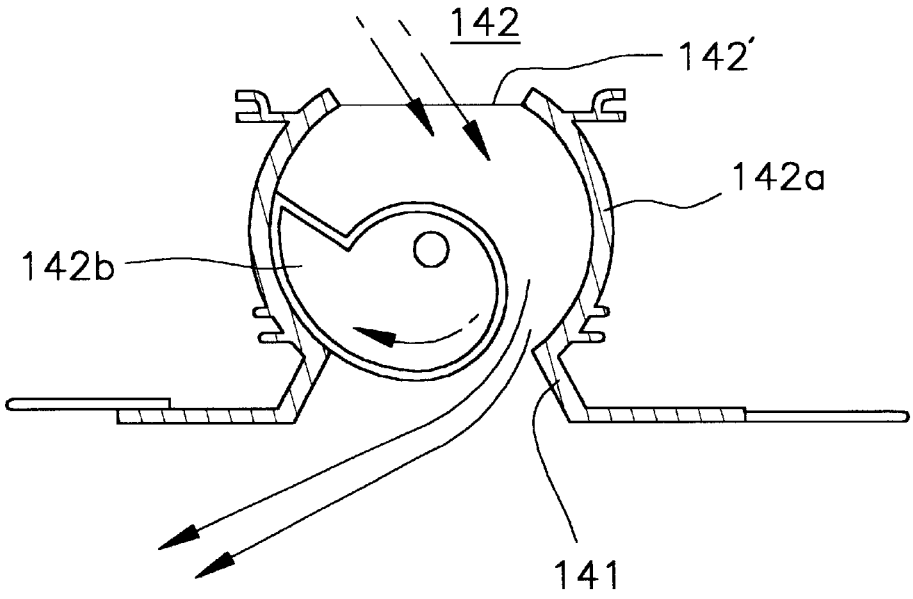
FIGS. 7A and 7B are section views of the blower of the means for capturing fumes of the present invention.
Figure 7B:
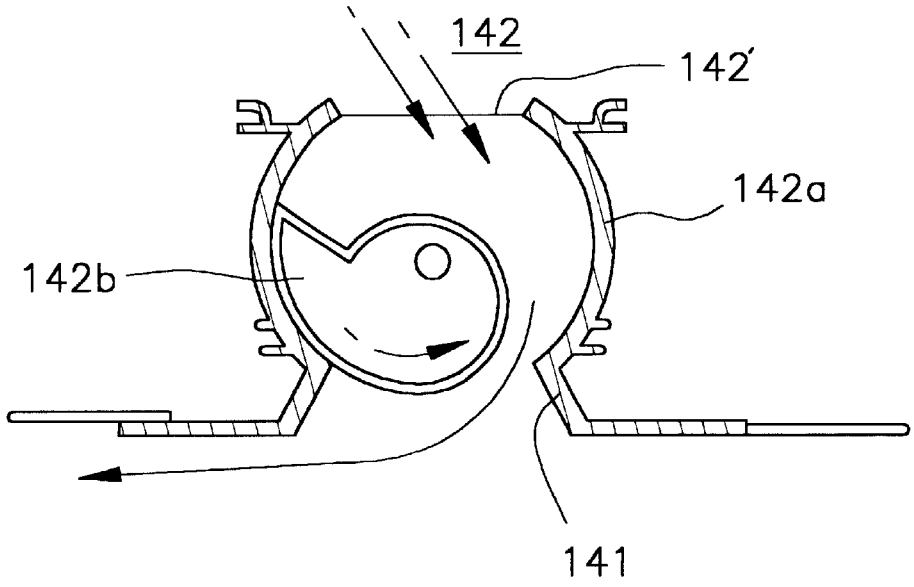

As shown in FIGS. 6, 7A, and 7B, the means for capturing fumes 140 comprises: a nozzle 141; a planar connection 143 between the suction element 110 and the nozzle 141; a blower 142 for jetting air through the nozzle 141 toward the suction element 110 along the planar connection 143 or ceiling surface, whereby the air jet from the nozzle 141 directs fumes rising from the cooking appliance 30 to the suction element 110.

As shown in FIGS. 7A and 7B, the blower 142 comprises a housing 142*a*, which is next to the nozzle 141 and has an opening 142' at the opposite side from the nozzle 141. The section of the housing 142*a* is circular. An eccentric rotor 142*b* rotates within the housing 142*a* and contacts the inner surface of the latter.

The blower 142 can jet air downward when the rotor 142*b* rotates in one direction, as shown in FIG. 7A, and can jet air to the side direction when the rotor 142*b* rotates in the other direction, as shown in FIG. 7B.

Figure 9:
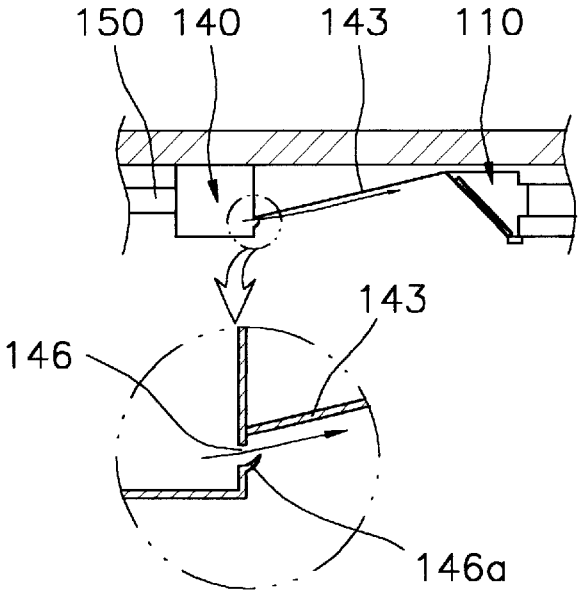
FIG. 9 is a schematic view of the means for capturing fumes according to another embodiment of the present invention.

In order to conserve space, it is preferable to provide the planar connection 143 with a slope in respect to the ceiling, as shown in FIGS. 4 and 9.

Figure 8:
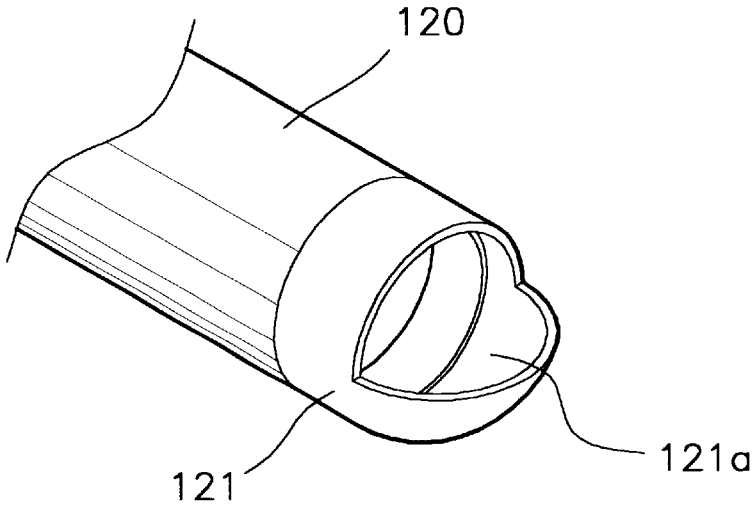
FIG. 8 is a perspective view of the deflector of the present invention.

As shown in FIG. 8, a deflector 121 having an end portion of hemispherical shape is added at the opposite end of the exhaust duct 120 from the suction element 110. An opening 121 a is formed in the end portion of the deflector.

As shown in FIG. 9, as another embodiment, the means for capturing fumes 140 can have a plurality of nozzle holes 146 facing the suction portion 110, each having a jet direction controlling portion 146*a*. In this embodiment, the plurality of nozzle holes collectively replaces the blower 142 in order to reduce costs.

The operation and effect of the ventilation system for a kitchen, having the above stricture, according to the present invention, are described as follows:

As explained above, when cooking, the fumes from the cooking appliance are inhaled into the kitchen hood that is generally installed in a kitchen.

As stated above, the efficiency of the kitchen hood 2 alone is generally less than 70 percent, and its efficiency decreases proportionally to the time in use because grease collects in a duct or a gate of the kitchen hood.

However, by employing the present invention, some of the remnant fumes overflowing the kitchen hood and rising with the heated air are discharged by the suction element 110 through the ventilation funnel 20 of the building.

The fumes that are not inhaled by the suction portion 110 spread along the ceiling of the kitchen, but can be captured by the means for capturing fumes 140 and discharged by the suction element 110.

The capturing process of the means for capturing fumes 140 is as follows:

When jetting air goes to the suction element 110 along the ceiling surface, the jetting air absorbs surrounding air because the air pressure of the jetting air decreases in comparison to surrounding air pressure as it passes along the ceiling surface, due to what is known as the "Coanda Effect."

This effect can be explained from the Bernoulli Equation and the Continuity Equation.

If we denote a point 1 at the nozzle 141 and denote a point 2 at another location on the ceiling, the total energy at point 1 is the same as total energy at point 2.

Because the area of point 1 is different from the area of point 2, the fluid (air) having a pressure and velocity (denoted, respectively, $P_1+V_1$) at point 1 becomes fluid having a different pressure and velocity (denoted, respectively, $P_2+V_2$) at point 2. However, the sum of the pressure and velocity is the same, namely, $P_1+V_1=P_2+V_2$.

Also, from the Continuity Equation, a flux (a quantity of air flow) Q is:

$$Q=A\cdot V=C\cdot A\cdot(2gh)^2$$

Where, C is the flux constant of a fluid.

A is area of a certain position.

g is the gravitational constant, and h is the height of the points.

So the jetting air absorbs surrounding air, because the air flux becomes lower by a factor of the reciprocal of the square root, which makes the air pressure lower. Also, the jetting velocity becomes greater by a factor of the square root.

As a result of the capturing process, as shown in FIGS. 3 and 4, a critical boundary line (two dotted lines in FIGS. 3 and 4) is formed, as it were, between the clean and cool space outside the boundary line and the hot and congested space inside the boundary line.

It is preferable to use a grease filter 111 in the suction element 110 for filtering grease, as shown in FIGS. 5A and 5B.

When air containing grease and fumes flows into the grease filter 111, the air passes quickly through a narrow gap of the filtering portion 111*a*, and the air slows when it reaches to the damper plate 111*b*.

Therefore, the grease and fumes contained in the air are separated in the damper plate 111*b* and the air is exhausted through the opening at both sides of the grease filter 111. Thus, the suction element 110 is not blocked by grease.

Also, the grease or other pollutants, which are separated in the damper plate 111*b*, collect in the collection element 112. Therefore, it is sometimes necessary to empty the collection element 112 to maintain the efficiency of the ventilation.

According to circumstances, a lighting apparatus 144, an air-conditioning apparatus 145, etc., can be installed as a single unit with the embodiment of the means for capturing fumes, as shown FIG. 6, so that one can use the kitchen space effectively.

INDUSTRIAL APPLICABILITY

As described above, the ventilation system for a kitchen of the present invention removes fumes from the space above a cooking appliance, working together with a kitchen hood disposed above the cooking appliance, so that the system can improve the air quality of a kitchen, prevent fumes from the cooking appliance spreading to other spaces, and decrease heat buildup in the kitchen.

What is claimed is:

1. A ventilation system for use in a kitchen within a building having a ventilation funnel for removing fumes from the space above a cooking appliance in the kitchen, said cooking appliance having a kitchen hood disposed above it, the system comprising:

suction means disposed at the ceiling of the kitchen near the location of the kitchen hood;

an exhaust duct connecting the suction means and the ventilation funnel;

an exhaust fan within said exhaust duct;

means for capturing fumes, said fume capturing means disposed at the ceiling near said suction means at the opposite side of said suction means from the kitchen hood, said fume capturing means, drawing fumes from the cooking appliance to said suction means by jetting air to said suction means along the surface of the ceiling; and air supply means to provide air from the upper portion of the kitchen to said means for capturing fumes, said air supply means having a suction fan disposed therein.

2. A system as claimed in claim 1 wherein the means for capturing fumes comprises:

a nozzle;

planar air communication means between said suction means and said nozzle, said planar communication means comprising a surface in contact with air within the kitchen; and blower means jetting air through said nozzle toward said suction means along said planar air communication means;

whereby the air jet from said nozzle attracts rising fumes from the cooking appliance and directs said fumes toward said suction means.

3. A system as claimed in the claim 2, wherein said blower means comprises:

a housing adjacent to said nozzle and having an opening therein at the opposite thereof from said nozzle, the section of said housing being circular; and an eccentric rotor rotating within said housing in contact with the inner surface thereof.

4. A system as claimed in the claim 1, wherein said suction means comprises:

a grease filter comprising a filtering portion and a damper plate, said grease filter disposed diagonally to the ceiling; and collection means for collecting and clearing grease or pollutant filtered by said grease filter.

5. A system as claimed in claim 1, further comprising a deflector having an end portion of hemispherical shape disposed at the end point of said exhaust duct opposite said suction means.

6. A system as claimed in the claim 1, wherein said means for capturing fumes comprises:

a plurality of nozzles directed toward said suction means, said nozzles including jet direction controlling means; and planar air communication means between said suction means and said plurality of nozzles, said planar communication means comprising a surface in contact with air within the kitchen;

whereby said plurality of nozzles jet air toward said suction portion along said planar air communication means, so that the air jet from said nozzles attracts rising fumes from the cooking appliance toward said suction means.

* * * * *